US006637686B2

(12) United States Patent
Antensteiner et al.

(10) Patent No.: US 6,637,686 B2
(45) Date of Patent: Oct. 28, 2003

(54) REFINER

(75) Inventors: Peter Antensteiner, Steyr (AT); Helmuth Gabl, Graz (AT); Andreas Gorton-Hülgerth, Graz (AT); Gerald Schadler, Vasoldsberg (AT)

(73) Assignee: Andritz AG, Graz (AT)

( * ) Notice: Subject to any disclaimer, the term of this patent is extended or adjusted under 35 U.S.C. 154(b) by 172 days.

(21) Appl. No.: 09/775,996

(22) Filed: Feb. 2, 2001

(65) Prior Publication Data

US 2001/0020660 A1 Sep. 13, 2001

(30) Foreign Application Priority Data

Feb. 3, 2000 (AT) ..... 168/2000

(51) Int. Cl.[7] ..... B02C 7/14
(52) U.S. Cl. ..... 241/259.1; 241/261.1
(58) Field of Search ..... 241/256, 259.1, 241/260, 261.1, 261.2, 247

(56) References Cited

U.S. PATENT DOCUMENTS

| | | | | | |
|---|---|---|---|---|---|
| 3,586,250 | A | * | 6/1971 | Shoovlin | 241/256 |
| 3,708,130 | A | * | 1/1973 | Perry | 241/260 |
| 3,806,050 | A | * | 4/1974 | Compston, Jr. | 241/261.1 |
| 4,396,161 | A | * | 8/1983 | Ruokolainen et al. | 241/247 |
| 4,401,280 | A | | 8/1983 | Reinhall | 241/247 |
| 4,986,480 | A | * | 1/1991 | Gullichsen et al. | 241/261.1 |
| 5,813,618 | A | * | 9/1998 | Prew | 241/259.1 |
| 2001/0022329 | A1 | * | 9/2001 | Antensteiner et al. | 241/259.1 |

OTHER PUBLICATIONS

EPO Search Report EP 1 122 356 A3, dated Oct. 8, 2001.

* cited by examiner

*Primary Examiner*—W. Donald Bray
(74) *Attorney, Agent, or Firm*—Alix, Yale & Ristas, LLP

(57) ABSTRACT

A refiner including a rotor and a stator defining a cylindrical or conical refining gap therebetween. A pulp feed channel extends in a radial direction from an inlet pipe to the refining gap.

13 Claims, 14 Drawing Sheets

REFINER

BACKGROUND OF THE INVENTION

This invention relates generally to refining apparatus. More particularly, the present invention relates to refining apparatus having a rotor and a stator forming a cylindrical or conical refining gap between rotor and stator.

Nowadays most of the refiners built are of twin disc or conical design. The disadvantages of the twin disc refiner are the changing relative speed along the length of the refining zone, a relatively high idle running rating and problems with centering the rotor, particularly at low throughputs. A significant disadvantage of the conical refiner known is the poor pumping effect. This leads to throughput difficulties and, as a result, the need to enlarge the grooves in the refining zone, which reduces the edge length. Possible other disadvantages are the relative displacement of the knives when being set in relation to one another, the need for a sturdy design as a result of the bearing forces occurring, and the difficulties in changing the refiner plates, which lead to high manufacturing costs. With a cylindrical refiner, as known from U.S. Pat. No. 5,813,618, for example, many of these disadvantages can be avoided, however there may be problems with the throughput, similar to those occurring with the conical refiner.

SUMMARY OF THE INVENTION

The aim of the invention is, therefore, to circumvent the disadvantages of the cylindrical and conical refiners known, in order to also permit higher throughputs.

The invention is thus characterized by the pulp feed channel extending in radial direction from the inlet pipe up to the refining gap. The pulp fed in is accelerated here by the rotating movement of the rotor in circumferential direction, which causes a pressure increase in the liquid. On the one hand, this pressure build-up eliminates the need for a feed pump and on the other, it provides good rotationally symmetrical inflow.

An advantageous configuration of the invention is characterized by the pulp feed channel having a rotationally symmetrical design. This results in even and rotationally symmetrical inflow to the refining flaps.

An advantageous further development of the invention is characterized by the inlet pipe connected to the pulp feed channel being on an axis which coincides with the axis of the rotor. In this way the pulp is fed directly into the axis of the refiner, which causes the pulp to be accelerated partially in the pipe before entering the pulp feed channel on the one hand and provides even more uniform pulp distribution on the other hand.

A favorable farther development of the invention is characterized by a disc being provided between the inlet pipe and the refining gap which limits the pulp feed channel. If the pulp is fed in outside the axis, the disc deflects the pulp at the shaft and directs it in rotational symmetry outwards, where the liquid is accelerated radially outwards between disc and front face of the rotor and subsequently flows evenly distributed into the refining gap.

A favorable configuration of the invention is characterized by a cylindrical rotor being provided. The rotor can also be conical, widening in the flow direction of the pulp or, as an alternative, a conical rotor narrowing in the flow direction of the pulp. Thus, the shape of refining gap suitable for the given requirements can be used.

An advantageous further development of the invention is characterized by a twin rotor being provided. With a twin rotor, where the rotor can be cylindrical as well as conical (widening cone or narrowing cone), it is possible to achieve a high throughput, also with even inflow to the refining gaps in rotational symmetry.

A favorable further development of the invention is characterized by the pulp feed channel being located between the two rotors. In particular, if an inlet pipe positioned in the axis of a rotor is used, the pulp can be fed into the center of the refiner and then directed outwards by the rotating movement, which leads to a corresponding rise in pressure. Further downstream the pulp is fed into the center of the corresponding refining gap, which achieves further evening out of the pulp feed.

An advantageous configuration of the invention is characterized by a cylindrical and a conical refining gap being arranged in series. This arrangement of a cylindrical and a conical refining gap in series can be achieved either on one rotor or using two different rotors positioned one behind the other. In both cases, the sequence of the series is arbitrary and depends only on the pulp characteristics to be obtained.

A favorable further development of the invention is characterized by internals, particularly paddles, being mounted in the pulp feed channel and/or inlet pipe. Internals of this kind in the inlet pipe or the pulp feed channel can significantly increase acceleration of the liquid even further in addition to the effects of wall friction.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
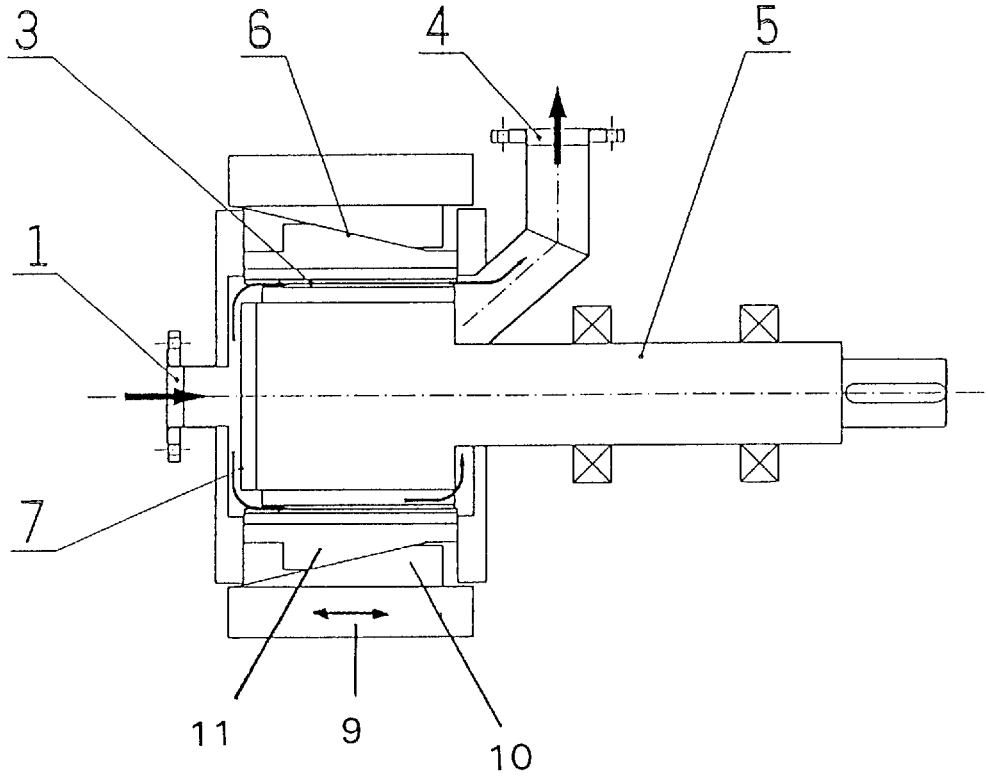
FIG. 1 is a schematic view of a first embodiment of a refiner in accordance with the invention.

FIG. 1 shows a refiner according to the invention, with inlet 1, pulp feed channel 7, refining zone 3, outlet 4, rotor 5 and stator 6. The pulp here flows into the refiner centrally through the inlet 1, positioned in the axis of the rotor 5. In the pulp feed channel 7 between rotor 5 and stator 6, the pulp is accelerated in circumferential direction due to wall friction or special internals (see FIG. 14), thus causing a pressure build-up. The pulp flows subsequently through the refining zone 3 and leaves the refiner through the outlet 4. The stator 6 comprises a ring movable in axial direction and on which a wedge 10 is mounted. The refiner plates are connected to a further wedge 11, with the refining gap 3 being set by moving the ring 9.

Figure 2:
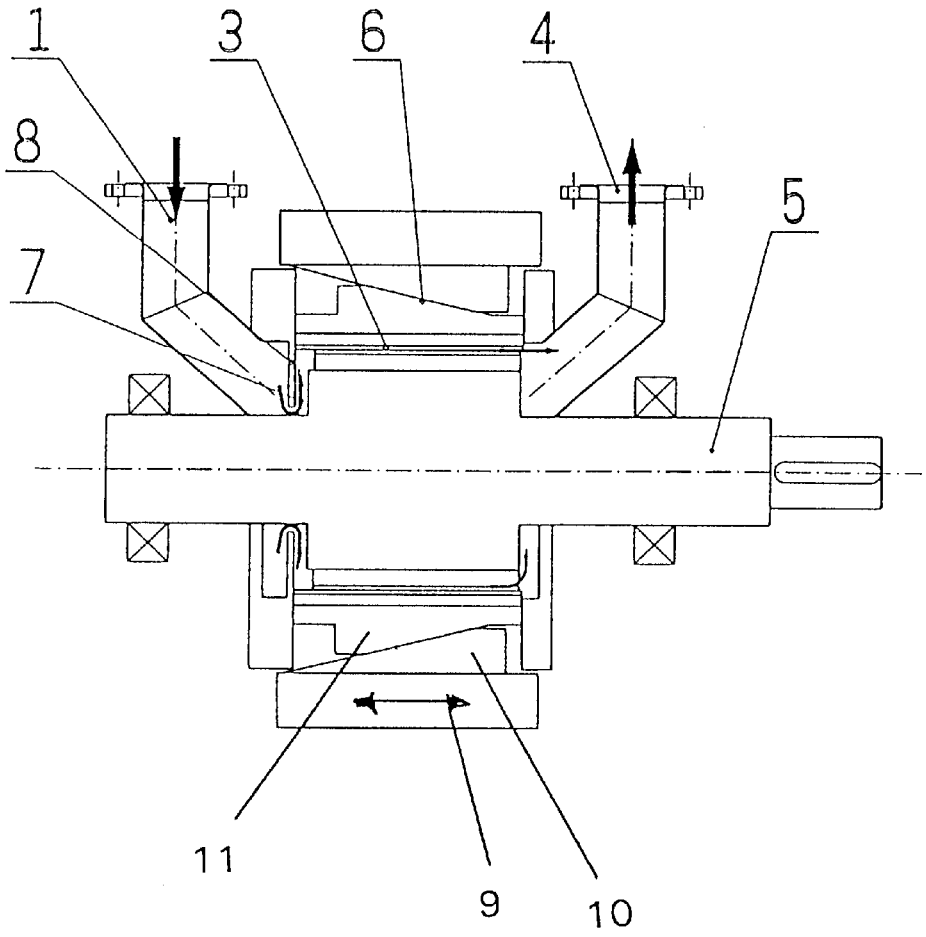
FIG. 2 is a schematic view of a second embodiment of a refiner in accordance with the invention.

FIG. 2 shows a refiner of analogous design, where the pulp is fed in from the side. The pulp flows here through the lateral inlet 1 into the refiner and is deflected towards the shaft by a disc 8. Here it is accelerated due to wall friction or special internals and enters the pulp feed channel 7 between disc 8 and rotor 5, where channel 7 acts as acceleration zone. In this acceleration zone the pulp is further accelerated in circumferential direction, thus causing the necessary pressure build-up. The pressure build-up here is in the region of 1.5 to 2 bar. Subsequently the pulp flows through the refining zone 3 and leaves the refiner through the outlet 4 located opposite the inlet 1. Here, too, the refining gap 3 is set by means of the adjustable wedges 10 and 11.

Figure 3:
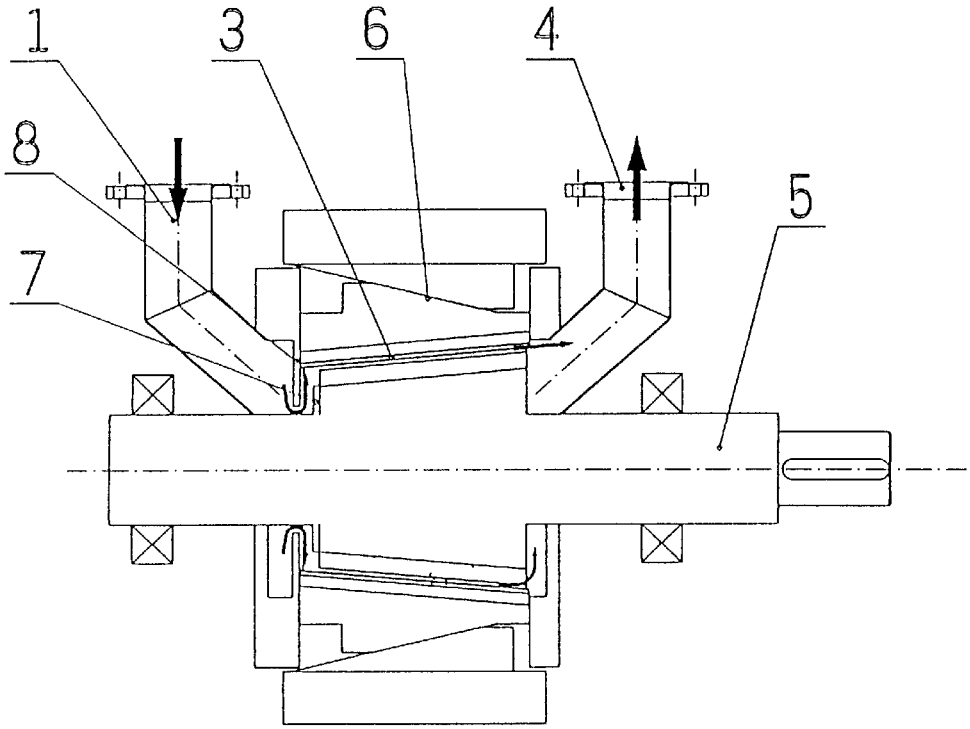
FIG. 3 is a schematic view of a third embodiment of a refiner in accordance with the invention.
Figure 4:
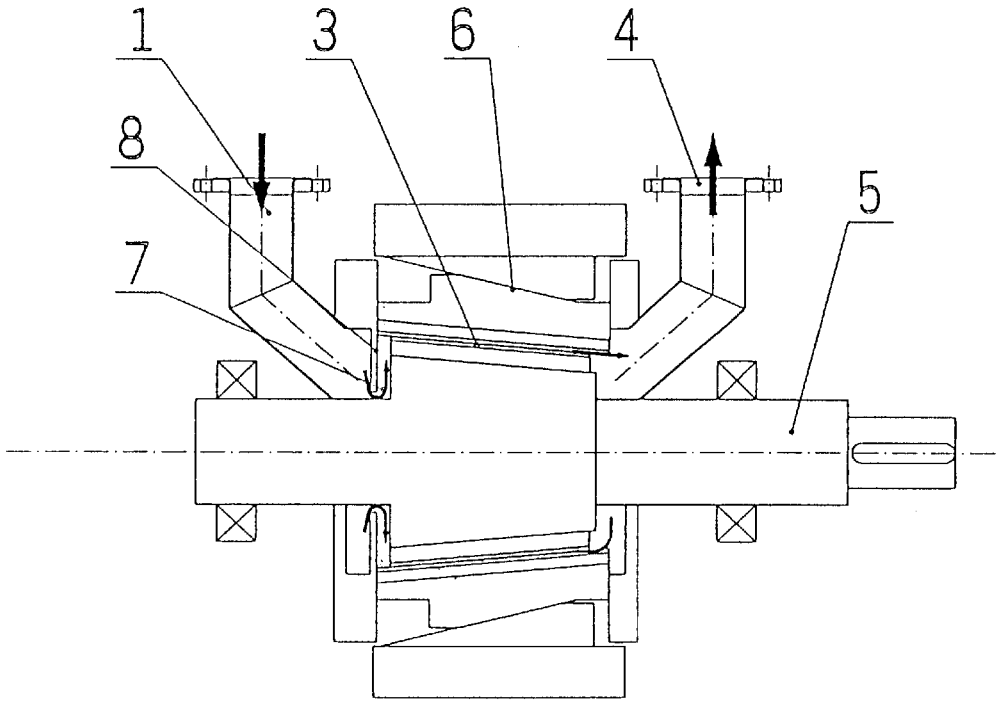
FIG. 4 is a schematic view of a fourth embodiment of a refiner in accordance with the invention.

FIG. 3 and FIG. 4 show analogous refiners to FIG. 2, with the same pulp feed, but where FIG. 3 contains a conical refiner with a widening cone and FIG. 4 a conical or tapered refiner with a narrowing cone.

Figure 5:
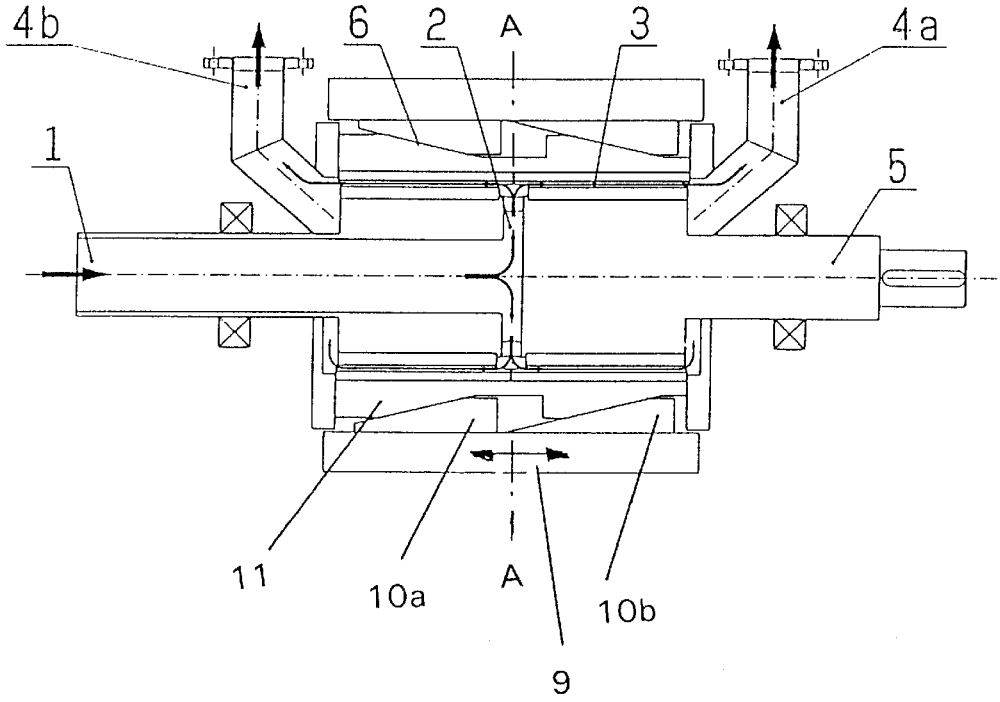
FIG. 5 is a schematic view of a fifth embodiment of a refiner in accordance with the invention.

FIG. 5 illustrates how a twin rotor refiner functions. In the design showed here the pulp flows through the inlet 1, formed as a hollow shaft, and through the rotor 5 to the pulp feed channel 2 located in the center. Due to acceleration of the pulp in circumferential direction in the hollow shaft of the inlet 1 and in the pulp feed channel 2, the pressure builds up here. The pulp flows subsequently through the refining zone outwards and leaves the refiner through the two outlets 4*a* and 4*b*, respectively. The refining gap 3 is adjusted here again using an axially adjustable ring 9. In addition to the facility of a wedge 10 acting over the entire length and a counterpart 11 connected to the refining plates, the present illustration shows a wedge 10 divided wedge 10*a* and wedge 10*b*. The surfaces of the counterpart 11 have corresponding wedge shaping. This permits a better and more even distribution of energy.

Figure 6:
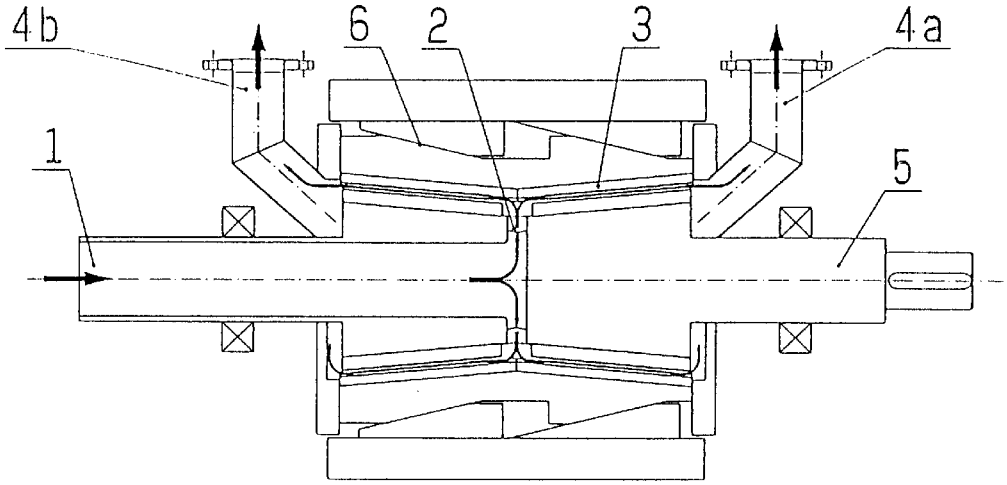
FIG. 6 is a schematic view of a sixth embodiment of a refiner in accordance with the invention.
Figure 7:
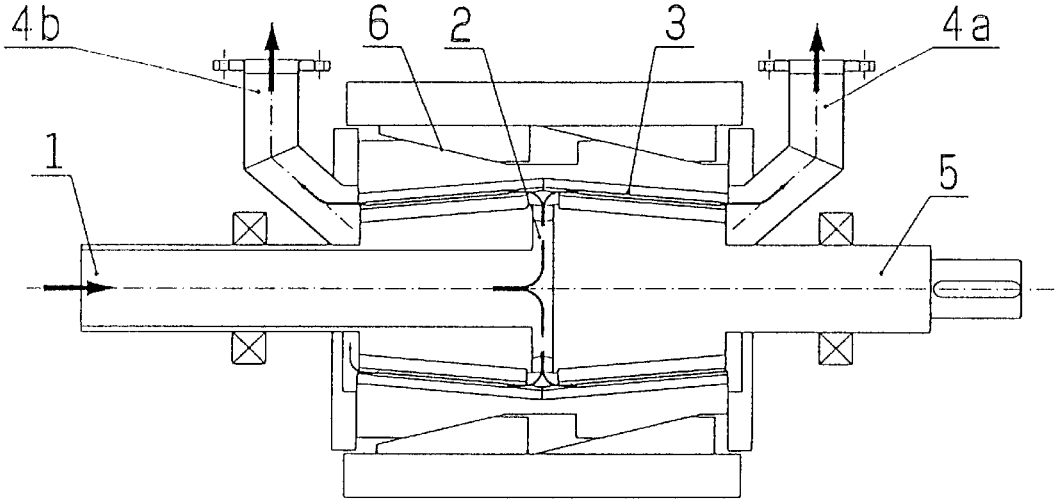
FIG. 7 is a schematic view of a seventh embodiment of a refiner in accordance with the invention.

FIGS. 6 and 7 show an analogous refiner to FIG. 5 with twin cone, where the conical shaping in FIG. 6 widens towards the outlets 4*a* and 4*b*, respectively, when viewed from the pulp feed channel 2, and narrows in FIG. 7. These refiners function in the same way as the twin cylinder refiner shown in FIG. 5.

Figure 8:
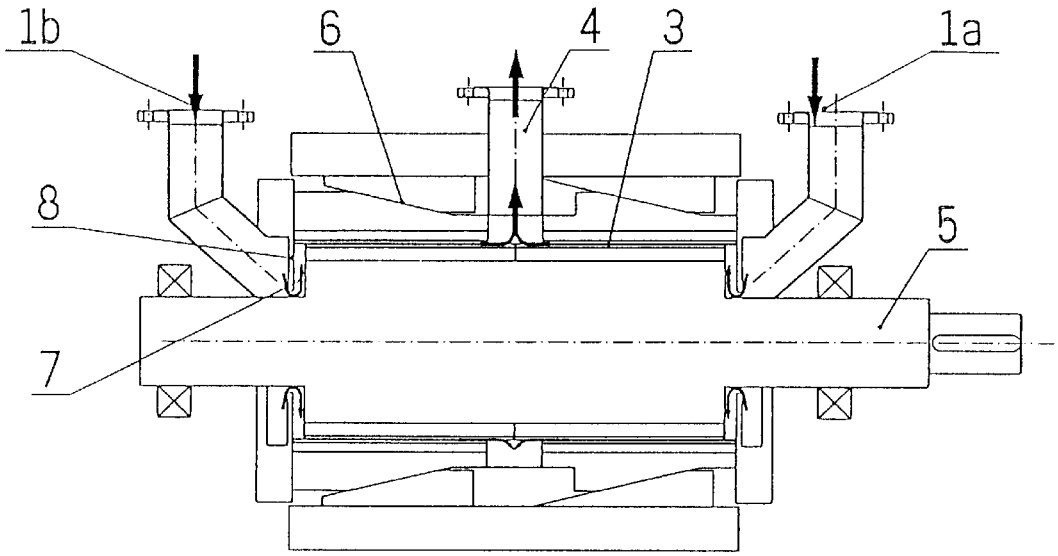
FIG. 8 is a schematic view of an eighth embodiment of a refiner in accordance with the invention.

A further possibility is illustrated in FIG. 8, where the pulp is fed in on both sides through the inlet 1*a* and 1*b*, respectively, towards the shaft and deflected into the pulp feed channel 7 by the disc 8. From there the pulp enters the refining gap 3 on both sides and is discharged centrally through the outlet 4. The same pulp routing is also possible with a twin cone, which can be designed as a widening or a narrowing cone from the outer inlet to the center outlet.

Figure 9:
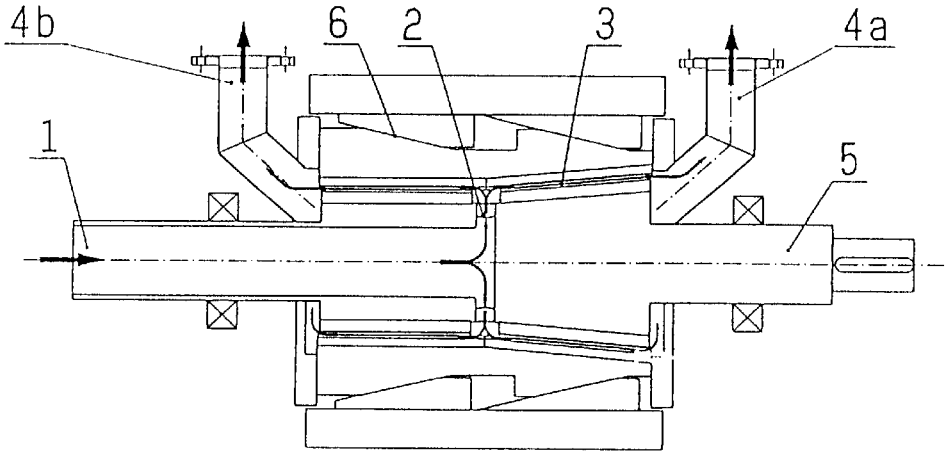
FIG. 9 is a schematic view of a ninth embodiment of a refiner in accordance with the invention.
Figure 10:
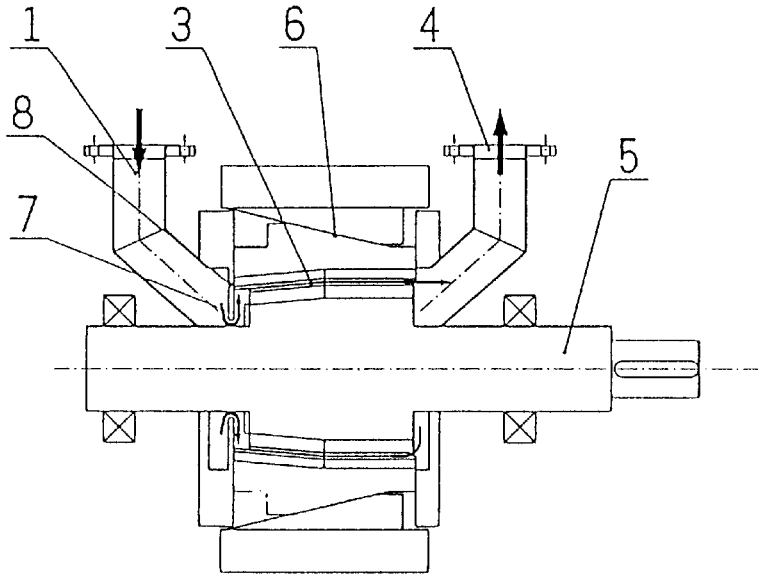
FIG. 10 is a schematic view of a tenth embodiment of a refiner in accordance with the invention.
Figure 11:
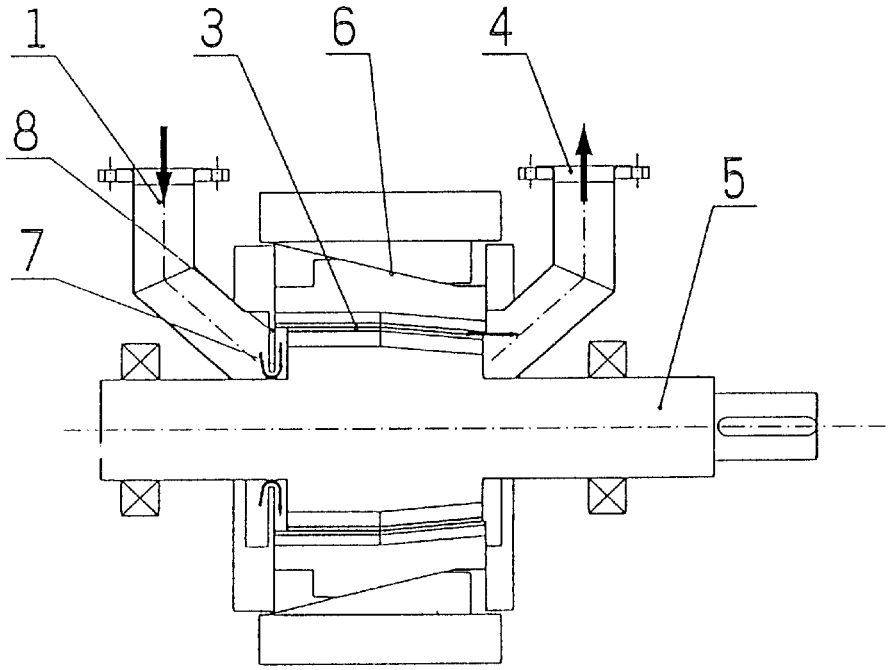
FIG. 11 is a schematic view of an eleventh embodiment of a refiner in accordance with the invention.
Figure 12:
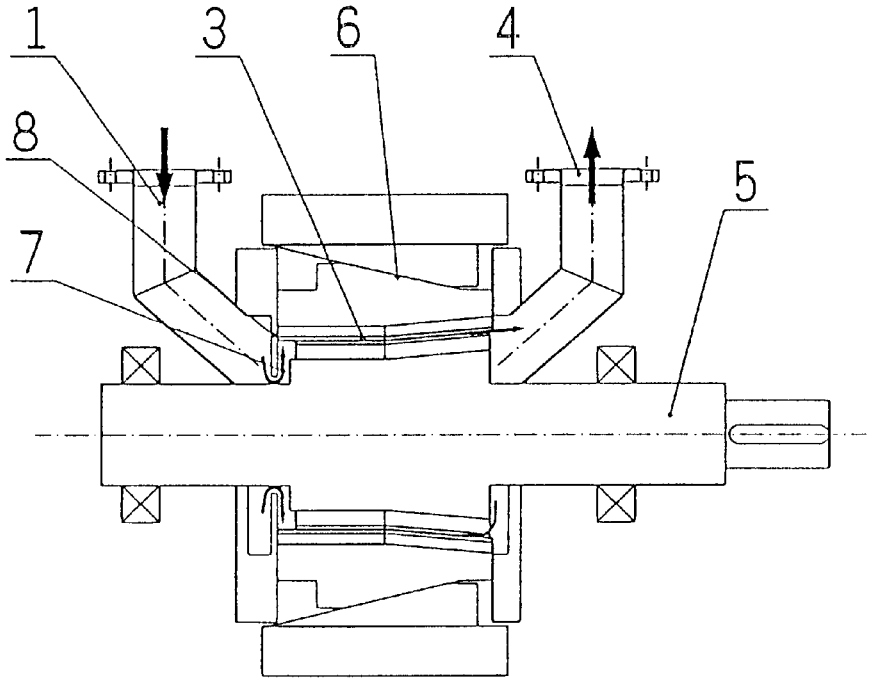
FIG. 12 is a schematic view of a twelfth embodiment of a refiner in accordance with the invention.
Figure 13:
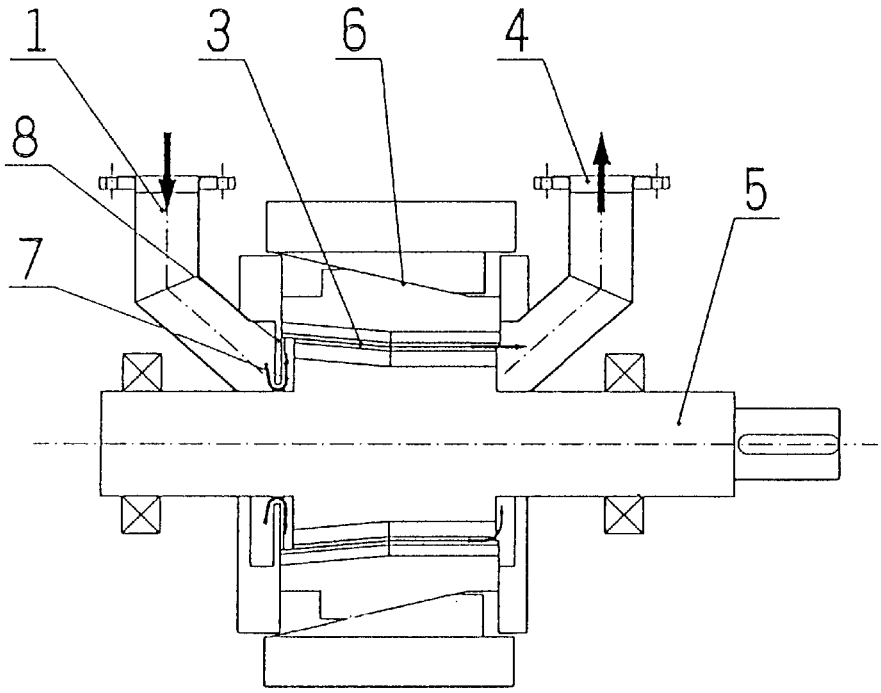
FIG. 13 is a schematic view of a thirteenth embodiment of a refiner in accordance with the invention.

Taking the example of a refiner with twin rotor and axial inlet 1 designed as a hollow shaft, FIG. 9 shows a combination of cylindrical and conical refining zones. In addition to the variant shown, the pulp can also flow in on two sides through the inlet, with deflection by a disc, and the outlet can be located centrally.

FIGS. 10 to 13 illustrate the combination of cylindrical and conical refining zones on one rotor. In this case the pulp can either flow through the cylindrical part (FIG. 11, FIG. 12) or through a conical part (FIG. 10, FIG. 13) first, where the cone has either a widening (FIG. 10, FIG. 12) or narrowing (FIG. 11, FIG. 13) shape. The definition of widening or narrowing for the shape of the cone is always determined by the flow direction of the pulp.

Figure 14:
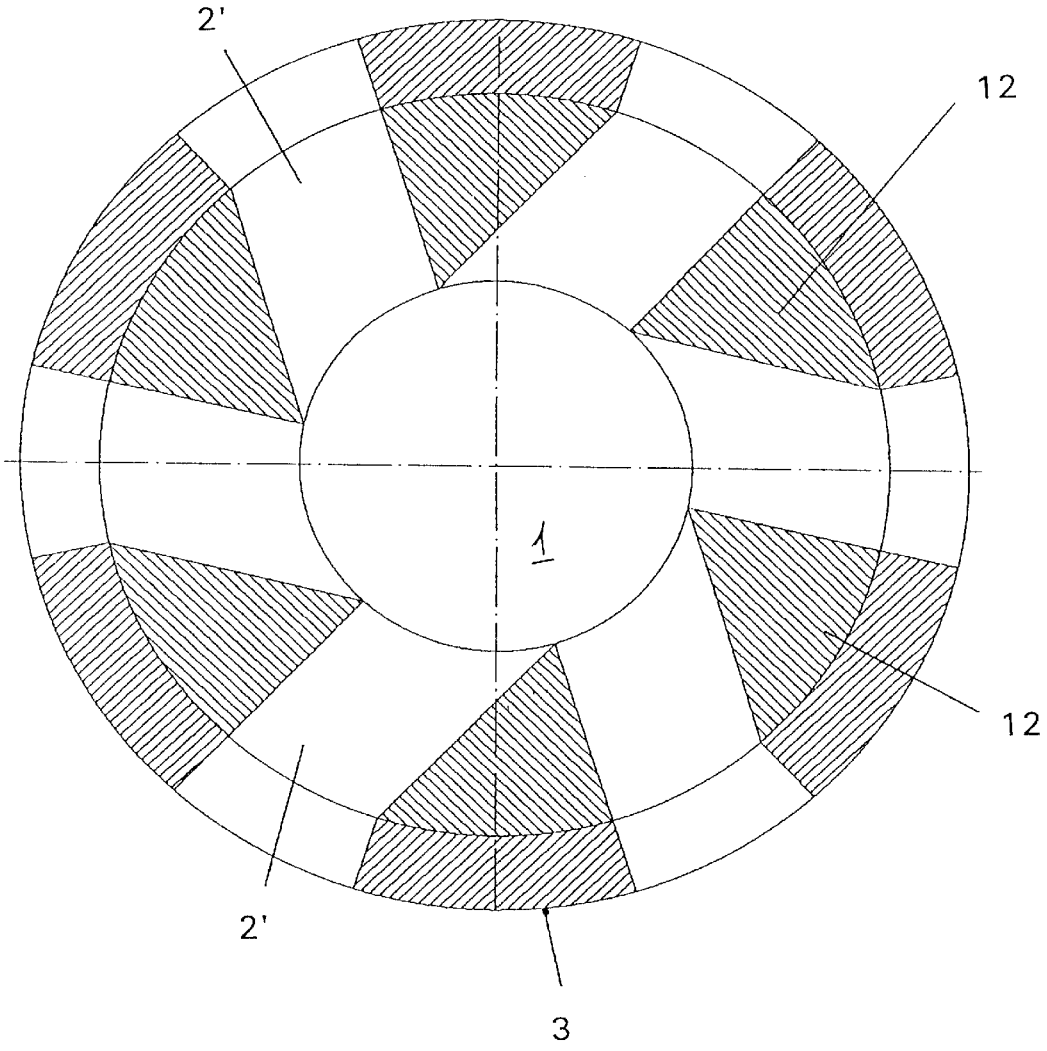
FIG. 14 is a cross section view taken along line A—A of FIG. 5.

FIG. 14 shows a section according to line A—A in FIG. 5. Here the internals 12, also known as vane or blade can be seen. These internals 12 divide the pulp feed cannel 2 into separate pulp feed channels 2' through which the pulp suspension is led from the centrally arranged feed 1 to the refining gap 3 on the outside. By these internals 12, which are manufactured as a filled wedge, the pulp suspension is accelerated additionally and a pressure increase builds up. The internals 12 however nary also be hollow or rounded on its surface, i.e. manufactured as blades. Such internals also may be used in the pulp feed channel 7 of e.g. FIGS. 1–4 or 8, 10–13 as also in the analogous variants to FIG. 5 in FIGS. 6, 7 or 9.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A refiner for refining a flow of pulp comprising:

a rotor rotatable about an axis;

a stator, the rotor and stator defining a refining gap therebetween;

an inlet pipe;

a pulp feed channel radially extending from the inlet pipe to the refining gap; and a substantially circular disc disposed between the inlet pipe and the refining gap, the disc having oppositely disposed circumferentially extending inlet and outlet surfaces;

wherein the inlet surface of the disc directs the flow of pulp radially inward toward the rotor and the outlet surface of the disc directs the flow of pulp radially outward into the refining gap around substantially the full circumference of the disc.

2. Refiner according to claim 1, wherein the pulp feed channel is rotationally symmetrical.

3. Refiner according to claim 1, wherein the inlet pipe is coaxial with the rotor.

4. Refiner according to claim 1, wherein the rotor is cylindrical.

5. Refiner according to claim 1, wherein the rotor is conical, widening in the flow direction of the pulp.

6. Refiner according to claim 1, wherein the rotor is conical, narrowing in the flow direction of the pulp.

7. Refiner according to claim 1, wherein the rotor is a twin rotor.

8. Refiner according to claim 7, wherein the pulp feed channel is located between the two rotors.

9. Refiner according to claim 1, wherein the refining gap includes a cylindrical portion and a conical portion arranged in series.

10. Refiner according to claim 1, further comprising internals mounted in the pulp feed channel and inlet pipe.

11. Refiner according to claim 1, further comprising internals mounted in the pulp feed channel or inlet pipe.

12. Refiner according to claim 10, wherein the internals are paddles.

13. Refiner according to claim 11, wherein the internals are paddles.

* * * * *